United States Patent [19]

Marchiori

[11] Patent Number: 4,778,034

[45] Date of Patent: Oct. 18, 1988

[54] DEVICE FOR CONTROLLING THE OPENING AND SHUTTING MOVEMENT OF SLIDING ELEVATOR DOORS

[75] Inventor: Sandro Marchiori, Casalmaggiore, Italy

[73] Assignee: Selcom S.p.A., Parma, Italy

[21] Appl. No.: 2,852

[22] Filed: Jan. 13, 1987

[30] Foreign Application Priority Data

Feb. 7, 1986 [IT] Italy ..... 40009 A/86

[51] Int. Cl.[4] ..... B66B 13/12

[52] U.S. Cl. ..... 187/521 C; 187/56

[58] Field of Search ..... 187/52 LC, 52 R, 51, 187/56; 49/65, 120

[56] References Cited

U.S. PATENT DOCUMENTS

| | | | |
|---|---|---|---|
| 2,003,399 | 6/1935 | Tamsitt | 187/52 LC |
| 2,859,835 | 11/1958 | Borden | 187/52 LC |
| 2,899,021 | 8/1959 | O'Grady | 187/52 LC |
| 2,974,751 | 3/1961 | Adams | 187/52 LC |
| 2,996,152 | 8/1961 | Olexson et al. | 187/52 LC |
| 3,033,317 | 5/1962 | Beck et al. | 187/52 R |
| 3,738,454 | 6/1973 | Atkey | 187/52 LC X |
| 4,148,377 | 4/1979 | Foelix et al. | 187/52 LC |
| 4,410,067 | 10/1983 | Leiner et al. | 187/52 LC |

*Primary Examiner*—F. J. Bartuska
*Assistant Examiner*—Nils E. Pedersen
*Attorney, Agent, or Firm*—Balogh, Osann, Kramer, Dvorak, Genova & Traub

[57] ABSTRACT

The device disclosed serves to control the opening and shutting movement of sliding elevator doors, and is designed to lock the compartment door (3) and the landing door (5) together when positioned face to face, in such a way that both doors open and shut as one. Such a device comprises a projecting catch fitted to the landing door (5), and a mechanism carried by the compartment door (3), which engages the catch and grips it between the upright surfaces of a pair of jaws (9, 10) that can be drawn together and spread apart within a horizontal plane, as well as being traversed horizontally at right angles to the landing door toward and away from the catch.

5 Claims, 3 Drawing Sheets

DEVICE FOR CONTROLLING THE OPENING AND SHUTTING MOVEMENT OF SLIDING ELEVATOR DOORS

BACKGROUND OF THE INVENTION

The invention relates to a device for controlling the opening and shutting movement of sliding elevator doors.

In a conventional elevator installation, the 'open' and 'shut' sliding movements of the landing door are brought about when the elevator compartment draws level with the landing at each floor; the actual movement derives from that of the door of the compartment, with which a mechanical linkage is established at the moment of opening and closing. Such a linkage incorporates a special catch component, attached either to the outermost section of a telescopic type compartment door, or to the single panel in a simple door assembly, that engages a corresponding latching system fastened to the inside of the landing door. The latching system will normally consist in a pair of parallel rollers or pins, which are disposed horizontally and set apart at a distance such as will allow the catch to locate between them during normal ascent and descent of the elevator car.

Clearly enough, the two rollers need to project from the face of the landing door, as well as from the relative internal wall of the elevator shaft, and in order to avoid their unwarranted contact with the elevator car, a certain minimum clearance must be left between the landing threshold and the compartment threshold, or the outermost surface of the car. The distance in question will not be less than 25 . . . 30 mm (1–1½")in most instances, and is the source of a number of drawbacks arising from the gap created between the landing and compartment thresholds. Transit into and out of the elevator is rendered problematic by the very wideness of the gap, especially with trolleys having small diameter wheels or casters.

Accordingly, the object of the invention is to overcome the drawbacks mentioned above.

SUMMARY OF THE INVENTION

The stated object is achieved with a device for controlling the opening and shutting movement of sliding elevator doors as disclosed herein, which is of a type that operates between the panels of the elevator compartment door and the landing door when these are positioned face to face, in such a way that both doors open and shut as one.

Such a device comprises a projecting catch component carried by the landing door, and a grab component which is carried by the compartment door and designed to engage the catch component, gripping it between the two opposed upright surfaces of a pair of jaws that can be drawn together and spread apart within a horizontal plane, at the same time traversing horizontally in a direction at right angles to the landing door toward and away from the catch component.

BRIEF DESCRIPTION OF THE DRAWINGS

The invention will now be described in detail, by way of example, with reference to the accompanying drawings, in which:

FIG. 4 1s the same section through II—11 in FIG. 2, showing the device in a different configuration to that of FIG. 3.

DESCRIPTION OF THE PREFERRED EMBODIMENT

Figure 1:
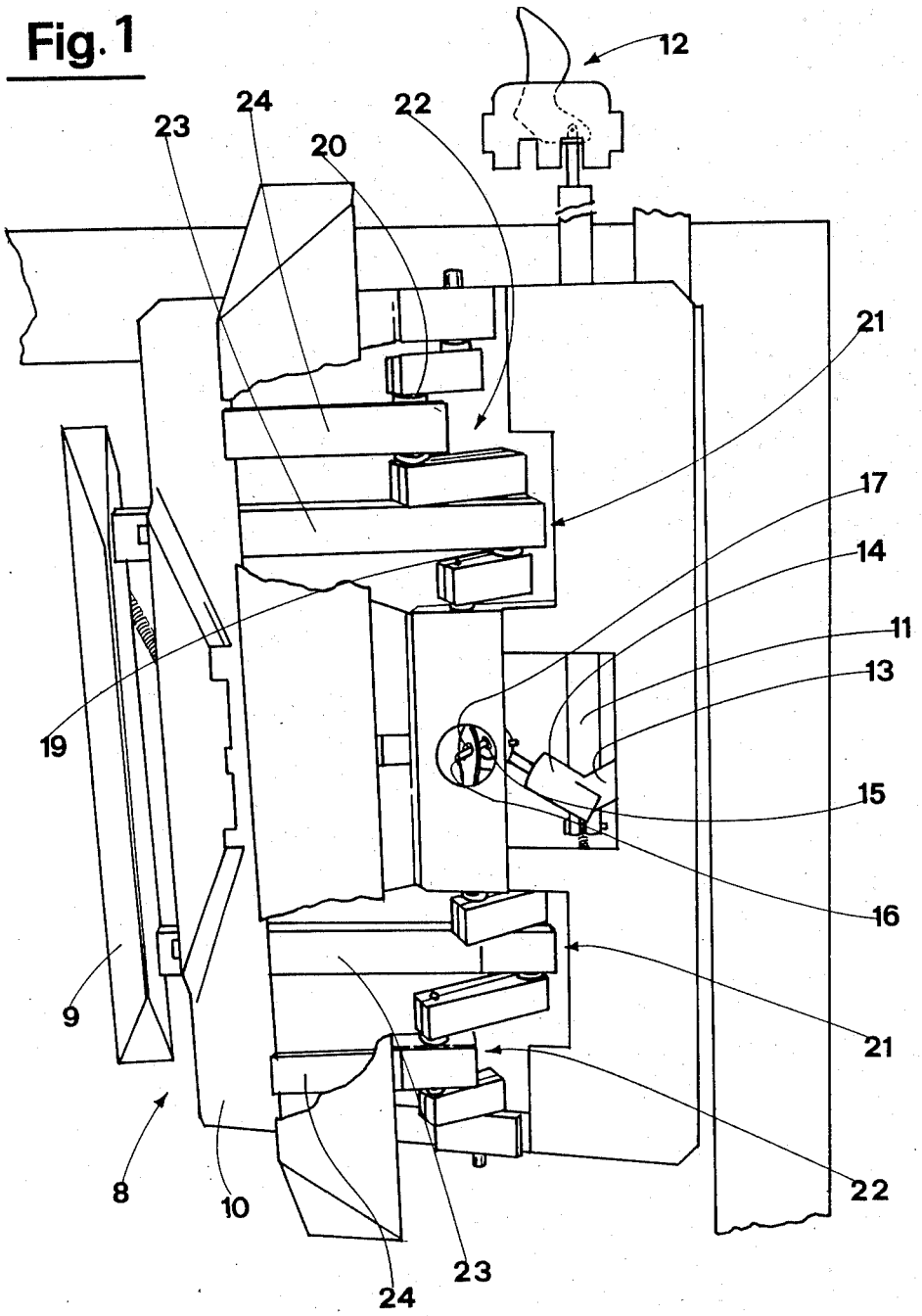
FIG. 1 is a perspective of the device.
Figure 2:
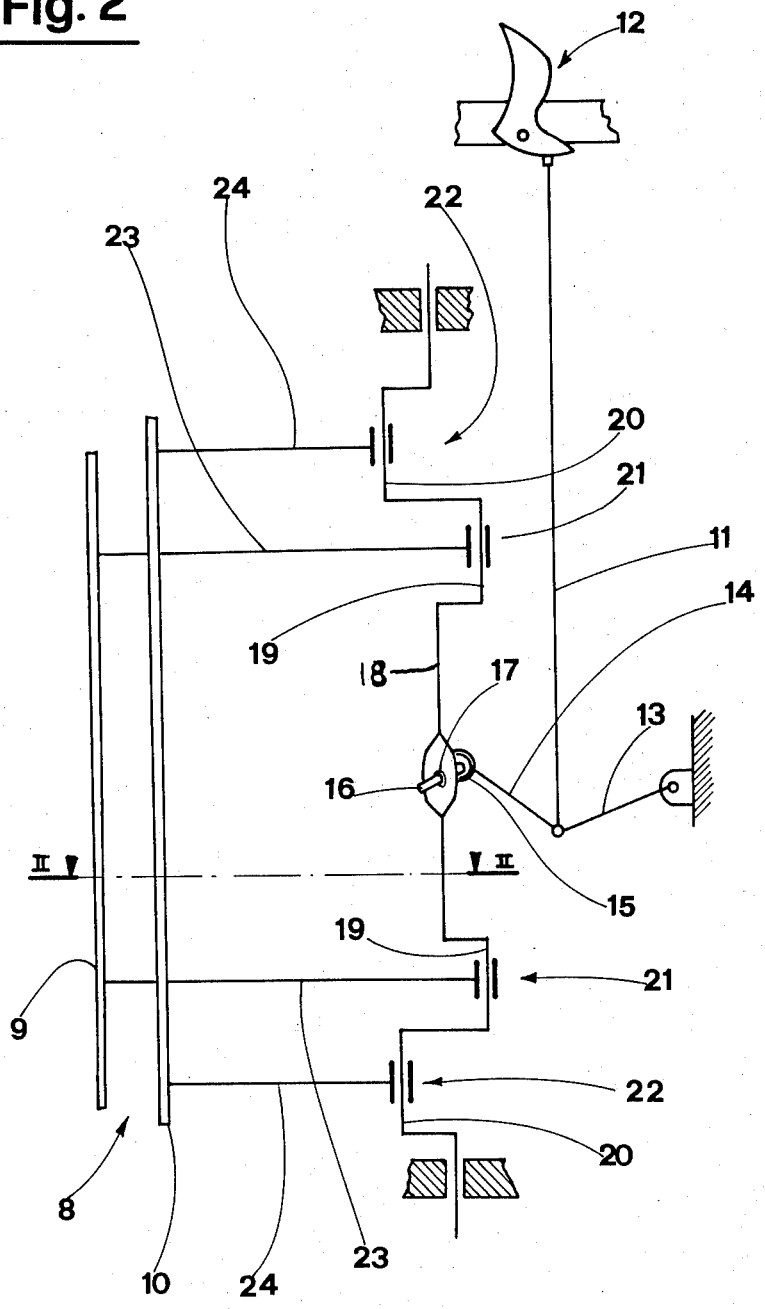
FIG. 2 is a schematic representation of the device viewed in vertical elevation.

With reference to the drawings, 1 and 2 denote the car of a elevator installation, and the shaft internally of which the car ascends and descends.

The door 3 of the elevator compartment consists in an assembly of sliding panels 4 which are propelled through their opening and shutting movement, guided parallel with one another, by a conventional drive unit not illustrated in the drawings.

The landing door 5 likewise consists in an assembly of sliding panels 6 that are guided through their opening and shutting movement by a system identical to that utilized for the compartment door 3, and can be operated only when positioned in exact face to face alignment with the panels 4 of the compartment door. The traversing movement necessary to open and shut the sliding panels 6 of the landing door 5 is transmitted directly from the panels 4 of the compartment door 3 by way of a device which causes the two sets of panels to slide as one.

According to the invention, such a device comprises a catch component, carried by the landing door 5 and projecting into the elevator shaft 2, which consists of a roller 7 with a horizontally disposed axis, and a grab component, denoted 8 in its entirety, carried by the compartment door 3 and designed to engage the roller 7, becoming rigidly associated therewith.

The grab component 8 is fitted either to the sliding panel 4 itself, or the part supporting it, and exhibits a pair of jaws 9 and 10 which are capable of movement within a horizontal plane, operated by a mechanism that draws them together and spreads them apart, as well as traversing them through a path at right angles to the landing door 5 toward and away from the roller 7. The mechanism incorporates a substantially upright rod 11 the top end of which engages with a conventional cam 12 that pushes down on the rod when the compartment door 3 is opened; the bottom end of the upright rod 11 is constrained to a given arc of movement by a crank lever 13, and is pivotably attached to one end of a further lever 14 the remaining end of which carries a ball joint 15, and a pivot 16 inserted through and axially slidable within a transverse hole 17 cut into the central section of a crank shaft 18 which rotates about a vertical axis.

The crank shaft 18 exhibits distinct top and bottom halves which are disposed symmetrically in relation to a horizontal median plane containing the axis of the hole 17, the top half incorporating two cranks 21 and 22 offset one from the other through a given angle, say 180°. The pin 19 of the one crank 21 is rotatably attached to one end of a connecting rod 23 the remaining end of which is rigidly associated with one jaw 9 of the pair, while the pin 20 of the other crank 22 is also rotatably attached to one end of a rod 24, the remaining end of which associates rigidly with the other jaw 10. It will be seen from FIG. 1 that this arrangement is mirrored in the bottom half of the crank shaft 18, below the horizontal median plane aforementioned; accordingly, the one jaw 9 is attached to the crank shaft 18 by way of two parallel connecting rods denoted 23, whilst the remaining jaw 10 is similarly attached to the self-same shaft by way of the two parallel rods denoted 24. The parallel connecting rods 23 and 24 of each set are vertically aligned, and all four rods will be seen to be located on one side of a vertical plane lying substantially at right angles to the doors 3 and 5 and containing the axis of the crank shaft 18 (see FIG. 4).

Figure 3:
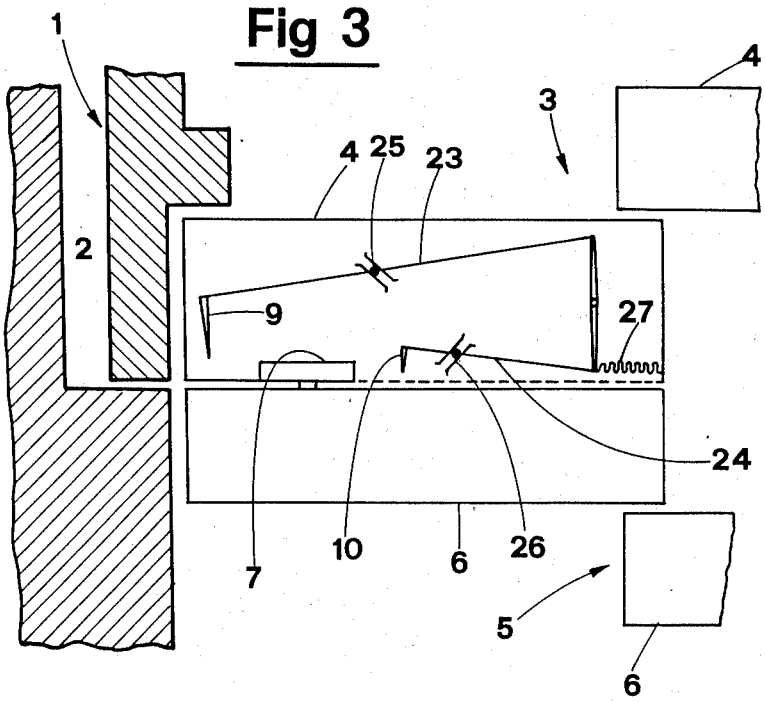
FIG. 3 is a schematic representation of part of the section through II—II in FIG. 2, showing the landing and compartment doors positioned face to face.
Figure 4:
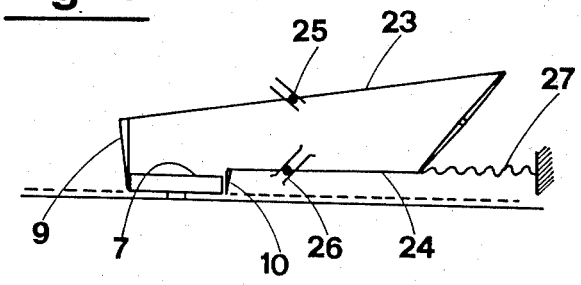

FIGS. 3 and 4 illustrate the two limit configurations assumed by the mechanism. FIG. 3 shows the jaws 9 and 10 spread completely apart and fully drawn back from the threshold of the landing door 5, whereas FIG. 4 shows the jaws drawn together to the point where their opposed vertical surfaces enter into contact with the outer surface of the catch roller 7; in the configuration of FIG. 4, the two jaws also occupy a position further forward than that of FIG. 3, i.e. nearer to the threshold of the landing door 5.

Movement of the two sets of connecting rods 23 and 24 is controlled by angled guides 25 and 26 which are positioned such as to ensure that the jaws 9 and 10 are drawn fully back from the landing door 5 when spread apart to the maximum, and urged fully forward toward the door 5 when drawn together, so that the catch roller 7 is firmly gripped.

Accordingly, a considerable reduction is obtained in the minimum clearance conventionally allowed between the landing threshold and the car to ensure that no contact occurs during ascent and descent.

27 denotes spring means attached directly to the crank shaft 18, the function of which is to bias the shaft toward the position whereby the jaws 9 and 10 are at the maximum distance apart. The moment that the cam 12 no longer impinges on the top end of the rod 11, the mechanism will be returned by the spring means 27 from the configuration of FIG. 4 to that illustrated in FIG. 3.

What is claimed:

1. Device for controlling the opening and shutting movement of sliding elevator doors, of the type that operates between the panels of the compartment door and the panels of the landing door when positioned face to face, in such a way that both doors open and shut as one, comprising:

a projecting catch component carried by the landing door;

a grab component carried by the compartment door and designed to engage the catch component by gripping it between two opposed upright surfaces of a pair of jaws that can be drawn together and spread apart within a horizontal plane, while traversing horizontally at right angles to the landing door toward an away from the catch component;

wherein the projecting catch component is embodied as a pin or roller fitted to the landing door with its axis horizontally disposed, and the grab component is operated by a mechanism comprising:

a substantially upright rod the top end of which is impinged upon by a cam device in such a way that the rod is pushed down as the compartment door opens;

a crank shaft linked mechanically with the bottom end of the upright rod, rotatable about a vertical axis, and incorporating at least two cranks offset one from the other through a given angle;

a first connecting rod, one end of which is rotatably attached to a pin of the one crank, its remaining end rigidly associated with one jaw of the pair;

a second connecting rod, one end of which is rotatably attached to a pin of the other crank, its remaining end rigidly associated with the other jaw of the pair; and guide means for guiding the movement of the first and second connecting rods.

2. Device as in claim 1 wherein the cranks are offset one from the other through 180°.

3. Device as in claim 2 wherein the connecting rods and the respective jaws occupy positions a short distance apart on the same side of a vertical plane containing the axis of the crank shaft and lying substantially at right angles to the door and to its path of movement.

4. Device as in claim 1 wherein movement of the two connecting rods is controlled by angled guides positioned such as to ensure that the jaws are drawn fully back from the landing door when spread apart to the maximum, and urged fully forward toward the landing door when drawn together, and including spring means attached to the crank shaft to ensure that the shaft is biased toward the position in which the jaws are fully spread apart.

5. Device for controlling the opening and shutting movement of sliding elevator doors, of the type that operates between the panels of the compartment door and the panels of the landing door when positioned face to face, in such a way that both doors open and shut as one, comprising:

a projecting catch compartment carried by the landing door;

a grab component means carried by the compartment door for engaging the catch component by gripping it between two opposed upright surfaces of a pair of jaws drawn together positively and spread apart positively by crank shaft means within a horizontal plane, while said jaws are traversing horizontally at right angles to the landing door toward and away from the catch component.

* * * * *